US007236734B2

(12) United States Patent
Ng et al.

(10) Patent No.: US 7,236,734 B2
(45) Date of Patent: Jun. 26, 2007

(54) METHOD AND APPARATUS FOR ELECTROSTATOGRAPHIC PRINTING WITH ENHANCED COLOR GAMUT

(75) Inventors: Yee S. Ng, Fairport, NY (US); Hwai-Tzuu Tai, Rochester, NY (US); Diane M. Herrick, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 269 days.

(21) Appl. No.: 11/062,972

(22) Filed: Feb. 22, 2005

(65) Prior Publication Data

US 2006/0188301 A1 Aug. 24, 2006

(51) Int. Cl.
*G03G 15/20* (2006.01)

(52) U.S. Cl. ..... 399/341; 399/122

(58) Field of Classification Search ..... 399/296, 399/320, 341, 342, 107, 110, 122
See application file for complete search history.

(56) References Cited

U.S. PATENT DOCUMENTS

| | | | | |
|---|---|---|---|---|
| 5,234,783 | A | 8/1993 | Ng | 430/45 |
| 5,778,295 | A | 7/1998 | Chen et al. | 399/329 |
| 6,567,641 | B1 | 5/2003 | Aslam et al. | 399/330 |
| 6,608,641 | B1 | 8/2003 | Alexandrovich et al. | 347/131 |
| 7,016,621 | B1 * | 3/2006 | Ng | 399/53 |

OTHER PUBLICATIONS

U.S. Appl. No. 10/933,986, filed Sep. 3, 2004, Ng.

* cited by examiner

*Primary Examiner*—Hoan Tran
(74) *Attorney, Agent, or Firm*—Lawrence P. Kessler

(57) ABSTRACT

A color electrostatographic printer apparatus applies respective color separation toner images to a receiver member to form a color image. A fuser station fuses, or at least tacks, the color image to the receiver. A clear toner overcoat is then applied to the fused color toner image using an inverse mask, and enhanced glossing of the image is provided by a belt glosser to improve color gamut.

60 Claims, 13 Drawing Sheets

METHOD AND APPARATUS FOR ELECTROSTATOGRAPHIC PRINTING WITH ENHANCED COLOR GAMUT

FIELD OF THE INVENTION

This invention relates to color reproduction apparatus and methods, and more particularly to color electrostatographic printers wherein color toner images are deposited upon a receiver.

BACKGROUND OF THE INVENTION

In an electrophotographic modular printing machine of known type, such as for example the NexPress 2100 printer manufactured by NexPress Solutions, Inc., of Rochester, N.Y., color toner images are made sequentially in a plurality of color imaging modules arranged in tandem, and the toner images are successively electrostatically transferred to a receiver sheet adhered to a transport web moved through the modules. Commercial machines of this type typically employ intermediate transfer members in the respective modules for the transfer to the receiver member of individual color separation toner images. However, the invention as described herein also contemplates the use of tandem and other electrostatographic printers that do not employ intermediate transfer members but rather transfer each color separation toner image directly to the receiver.

Electrostatographic printers having a three, four, or more color (multi-color) capability are known to also provide an additional toner depositing station for depositing clear toner. The provision of a clear toner overcoat to a color print is desirable for providing protection of the print from fingerprints and reducing certain visual artifacts. However, a clear toner overcoat will add cost and may reduce color gamut of the print, so it is desirable to provide for operator/user selection to determine whether or not a clear toner overcoat will be applied to the entire print. In U.S. Pat. No. 5,234,783, issued on Aug. 10, 1993, by Yee S. Ng, it is noted that in lieu of providing a uniform layer of clear toner, a layer that varies inversely according to heights of the toner stacks may be used instead as a compromise approach to even toner stack heights. As is known, the respective color toners are deposited one upon the other at respective locations on the receiver and the height of a respective color toner stack in the sum of the toner contributions of each respective color and provides the print with a more even or uniform gloss.

It is recognized that a multi-color image forming process that employs a clear toner overcoat provides for prints with a color gamut that is relatively compromised. However, the use of such clear toner is desirable to improve abrasion resistance of prints. It would therefore be desirable to provide a method and apparatus that unexpectedly achieves an improved color gamut with application of clear toner, and substantially maintains the benefits of print protection provided by the presence of the clear toner overcoat.

SUMMARY OF THE INVENTION

The above and other aspects of the invention are realized in accordance with a first aspect of the invention wherein there is provided a method of forming a multi-color image on a receiver comprising forming a multi-color toner image on the receiver with toners of at least three different colors of toner pigments which form various combinations of color at different pixel locations on the receiver to form the multi-color toner image thereon; forming a clear toner overcoat upon the multi-color toner image, the clear toner overcoat being deposited as an inverse mask; pre-fusing the multi-color toner image and clear toner overcoat to the receiver to at least tack the toners forming the multi-color toner image and the clear toner overcoat; and fusing the clear toner overcoat and the multi-color toner image using a belt fuser to fix the clear toner overcoat to the receiver and/or provide an improved gloss to the multi-color toner image.

In accordance with a second aspect of the invention, there is provided a method of forming a multi-color image on a receiver comprising forming a multi-color toner image on the receiver with toners of at least three different colors of toner pigments which form various combinations of color at different pixel locations on the receiver to form the multi-color toner image thereon; pre-fusing the multi-color toner image to the receiver to at least tack the toners forming the multi-color toner image; forming a clear toner overcoat upon the at least tacked multi-color toner image, the clear toner overcoat being deposited as an inverse mask; and fusing the clear toner overcoat and the multi-color toner image using a belt fuser to fix the clear toner overcoat to the receiver and provide an improved gloss to the multi-color toner image.

In accordance with a third aspect of the invention, there is provided a system for printing color images comprising a tandem color electrostatographic printer apparatus having three or more color printing stations for applying respective color separation toner images to a receiver member passing there through in a single pass to form a multi-color image; a fusing station for fusing the multi-color image; a clear toner overcoat printing station for applying a clear toner overcoat upon the multi-color toner image in the form of an inverse mask; and a belt glosser for providing enhanced gloss to the multi-color image having the clear toner overcoat.

In accordance with a fourth aspect of the invention, there is provided a method of forming a multi-color image on a receiver comprising forming a multi-color image on the receiver comprised of materials of at least three different colors which form various combinations of color at different pixel locations on the receiver to form the multi-color image thereon; forming a clear overcoat upon the multi-color toner image, the clear overcoat being deposited as an inverse mask having a gentle roll off in the mid-tone region; and subjecting the multi-color toner image with the clear toner overcoat to heat and pressure in a belt glosser to provide an improved gloss to the multi-color toner image.

In accordance with a fifth aspect of the invention, there is provided a method of forming a single color image on a receiver comprising forming a color toner image on the receiver with a toner with toner pigment in the selected color; forming a clear toner overcoat upon the color toner image, the clear toner overcoat being deposited as an inverse mask; pre-fusing the color toner image and clear toner overcoat to the receiver to at least tack the color toner image and the clear toner overcoat; and fusing the clear toner overcoat and the color toner image using a belt fuser to fix the clear toner overcoat to the receiver and/or provide an improved gloss to the color toner image.

In accordance with a sixth aspect of the invention, there is provided a method of forming a multi-color image on a receiver comprising forming a multi-color image on the receiver with materials of at least three different colors which form various combinations of color at different pixel locations on the receiver to form the multi-color image thereon; forming a clear overcoat upon the multi-color toner image, the clear overcoat being deposited as an inverse mask having a gentle roll off in the mid-tone region; and subjecting the multi-color toner image with the clear toner overcoat to heat and pressure to fuse the multi-color toner image with the clear toner overcoat to the receiver to form a print wherein the print that is formed exhibits lower granularity than a similar multi-color image on a similar receiver and which is not subject to an overcoat of clear toner.

In accordance with still another aspect of the invention, there is provided a method of forming a print having a multi-color image supported on a receiver comprising forming a multi-color toner image on the receiver with toners of at least three different colors of toner pigments which form various combinations of color at different pixel locations on the receiver to form the multi-color toner image thereon; forming a clear toner overcoat upon the multi-color toner image, the clear toner overcoat being deposited as an inverse mask; pre-fusing the multi-color toner image and clear toner overcoat to the receiver to at least tack the toners forming the multi-color toner image and the clear toner overcoat; and subjecting the clear toner overcoat and the multi-color toner image to heat and pressure using a belt fuser to provide an improved color gamut to the image.

Other objects, advantages and novel features of the present invention will become more apparent from the following detailed description of the invention when considered in conjunction with the accompanying drawings.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings some elements have been removed and relative proportions depicted of the various disclosed elements may not be representative of the actual proportions, and some of the dimensions may be selectively exaggerated.

DETAILED DESCRIPTION OF THE INVENTION

Figure 1A:
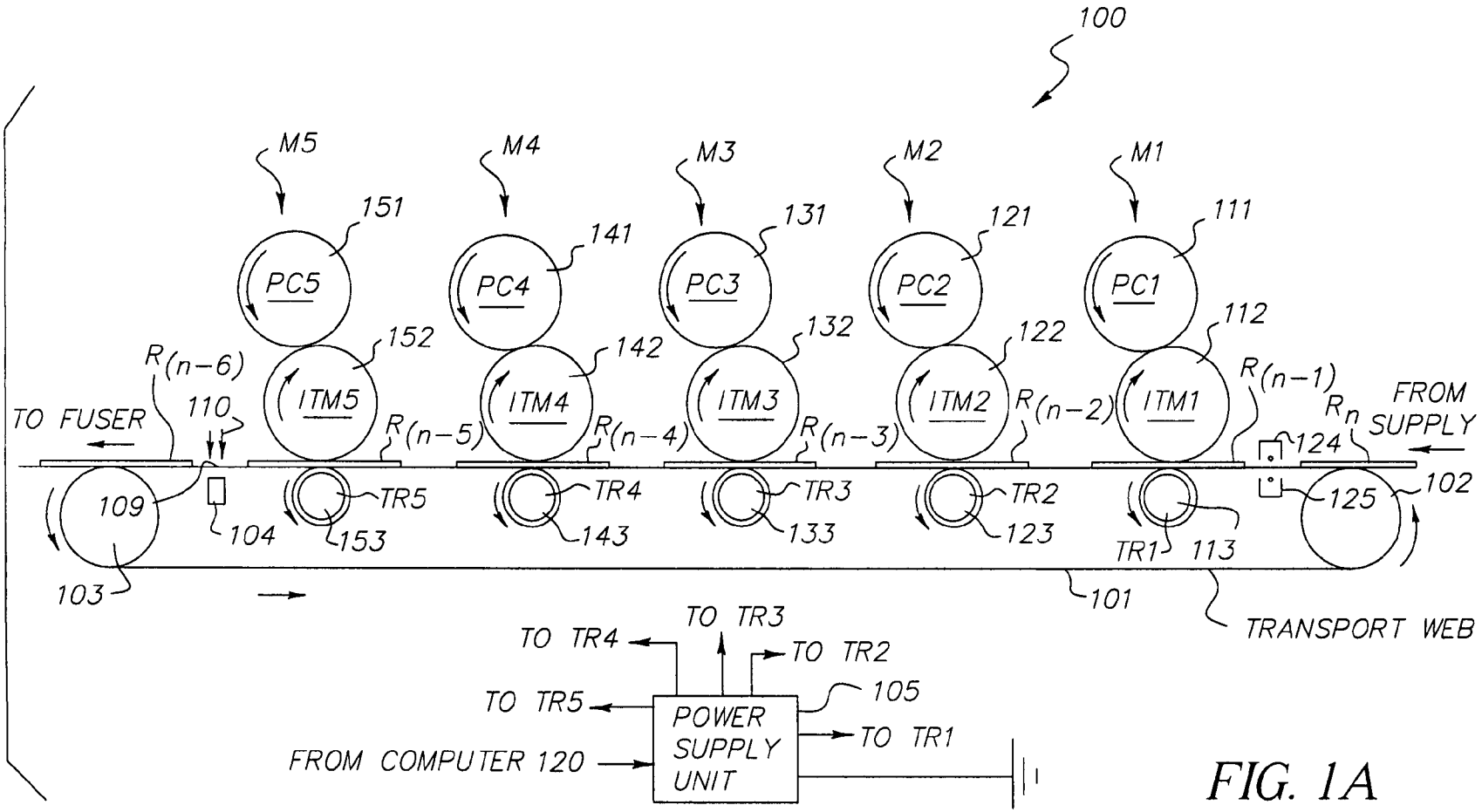
FIGS. 1A and 1B are a schematic of a tandem electrophotographic print engine or printer apparatus, having five printing stations or modules that may be used in accordance with the invention to generate multi-color prints.
Figure 1B:
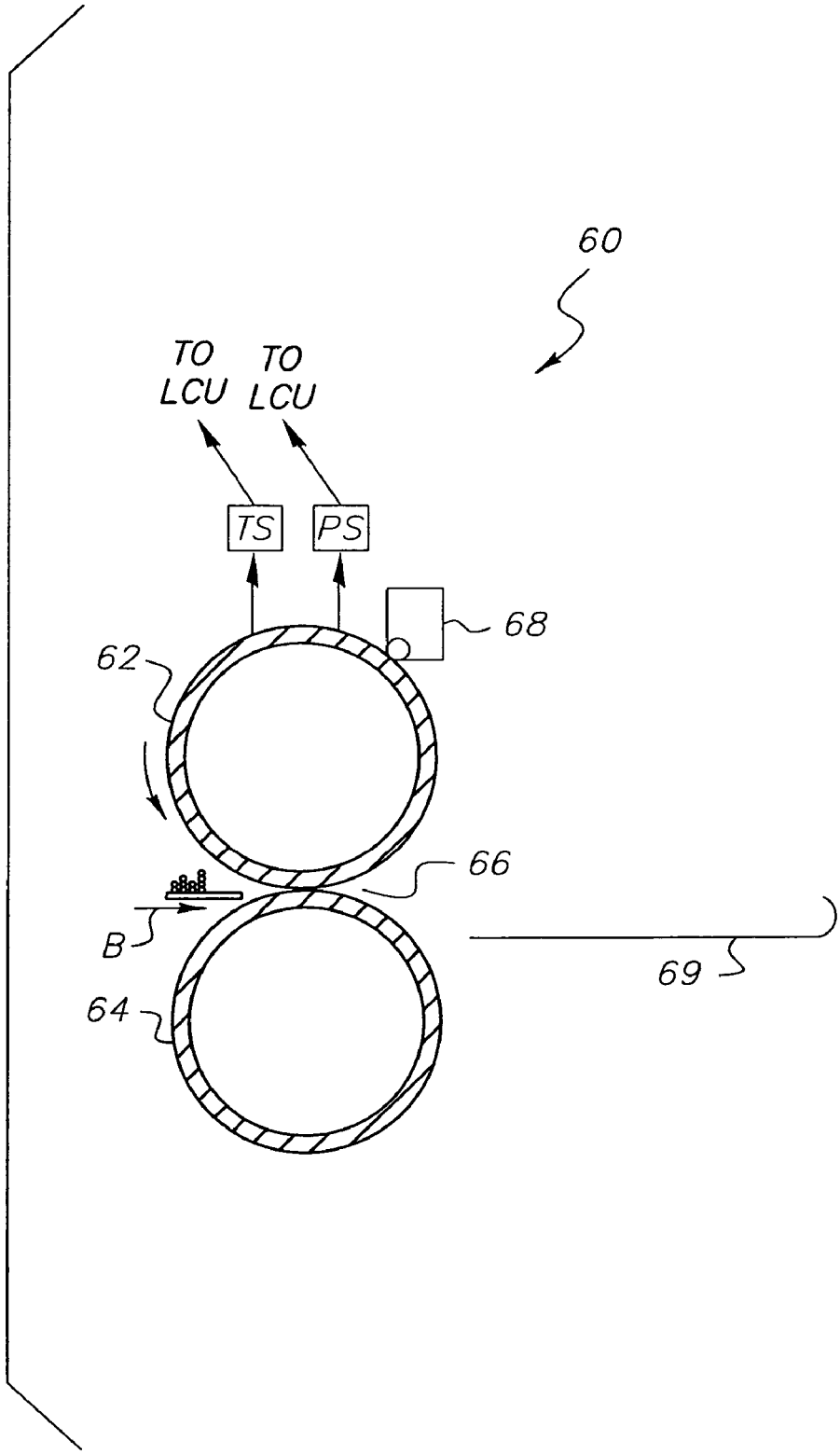

FIGS. 1A and 1B are elevational views showing schematically portions of an electrophotographic print engine or printer apparatus suitable for printing of multi-color toner images. Although one embodiment of the invention involves printing using an electrophotographic engine having five sets of single-color image producing or printing stations or modules that are arranged in a so-called tandem arrangement, the invention contemplates that three, four, five, or more than five colors may be combined on a single receiver or receiver member. The invention further contemplates that the images formed therein may also be generated using electrographic writers and thus the apparatus of the invention is broadly referred to as an electrostatographic reproduction or printer apparatus. In its broader aspects the invention contemplates that other processes may be used to create the multi-color images and then be coated with a clear toner overcoat in accordance with the teachings herein.

In FIG. 1A there is shown an electrostatographic printer apparatus 100 having a number of tandemly arranged electrostatographic image forming modules or printing stations M1, M2, M3, M4, and M5. Each of the modules M1 through M4 generates a single-color toner image for transfer to a receiver member successively moved through the modules. Module M5 is used to provide a clear toner overcoat as will be described in greater detail below. Each receiver member during a single pass through the five modules can have transferred in registration thereto up to four single-color toner images to form a multi-color image with a clear toner overcoat. As used herein, the term multi-color implies that, in an image formed on the receiver, combinations of subsets of plural primary colors are combined to form other colors on the receiver at various locations on the receiver, and that the plural primary colors participate to form process colors in at least some of the subsets wherein each of the primary colors may be combined with one more of the other primary colors at a particular location on the receiver to form a color different than the specific color toners combined at that location. In a particular embodiment, M1 forms black (K) toner color separation images, M2 forms yellow (Y) toner color separation images, M3 forms magenta (M) toner color separation images, and M4 forms cyan (C) toner color separation images. Other printing stations or modules may be added before the clear toner printing station or module to form additional colors on the receiver. Thus, additional modules may form one of red, blue, green or other fifth or more color separation images. It is well known that the four primary colors cyan, magenta, yellow and black may combine in various combinations of subsets thereof to form a representative spectrum of colors and having a respective gamut or range dependent upon the materials used and process used for forming the colors. A fifth color may be added to improve the color gamut. In addition to adding to the color gamut, the fifth color may also be used as a specialty color toner image, such as for making proprietary logos.

Receiver members, or receivers, are delivered from a paper supply unit (not shown) and transported through the modules. The receiver members are adhered, for example, preferably electrostatically via coupled corona tack down chargers 124, 125 to an endless transport web 101 entrained and driven around rollers 102, 103. Alternatively, mechanical devices such as grippers, as is well known, may be used to adhere the receiver members to the transport web 101. The receiver members are preferably passed through a paper-conditioning unit (not shown) before entering the first module. Each of the modules includes a photoconductive imaging roller, an intermediate transfer member roller, and a transfer backup roller. Thus in module M1, a black color toner separation image can be created on the photoconductive imaging roller 111 (PC1), transferred to intermediate transfer member 112 (ITM1), and transferred again to a receiver sheet moving through a transfer station, which transfer station includes ITM1 forming a pressure nip with a transfer backup roller 113 (TR1). Similarly, modules M2, M3, M4, M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member, $R_n$, arriving from the supply, is shown passing over roller 102 for subsequent entry into the transfer station of the first module, M1, in which the preceding receiver member $R_{(n-1)}$ is shown. Similarly, receiver members $R_{(n-2)}$, $R_{(n-3)}$, $R_{(n-4)}$, and $R_{(n-5)}$ are shown moving respectively through the transfer stations of modules M2, M3, M4, and M5. An unfused print formed on receiver member $R_{(n-6)}$ is moving as shown towards a fuser 60 for fusing the unfused print, the fuser being shown in FIG. 1B.

A power supply unit 105 provides individual transfer currents to the transfer backup rollers TR1, TR2, TR3, TR4, and TR5 respectively. A logic and control unit 230 (FIG. 2) includes one or more computers and in response to signals from various sensors associated with the apparatus provides timing and control signals to the respective components to provide control of the various components and process control parameters of the apparatus in accordance with well understood and known employments. A cleaning station (not shown) for cleaning web 101 is also typically provided to allow continued reuse thereof.

Figure 2:
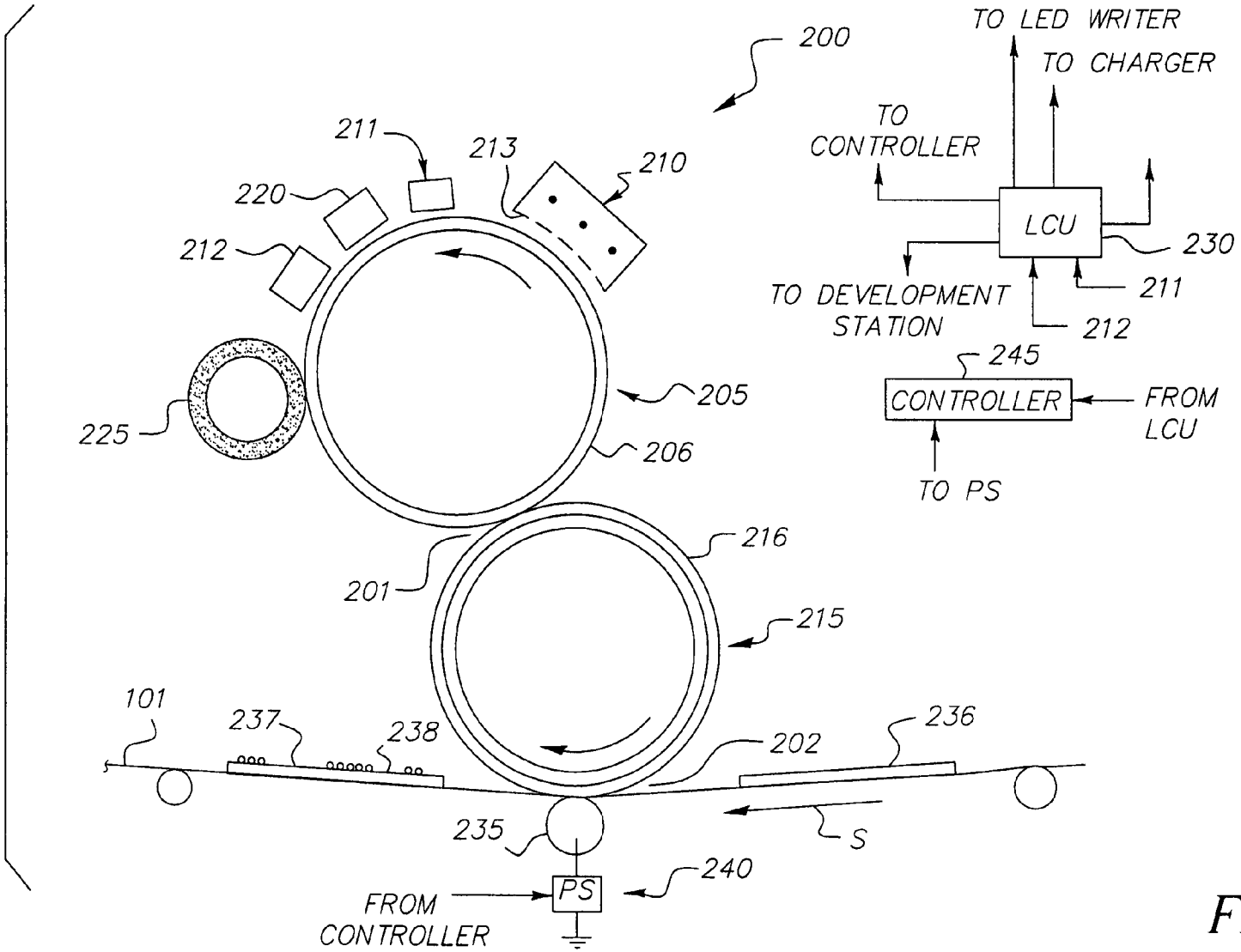
FIG. 2 is a schematic of a representative printing station or module used in the print engine apparatus of FIG. 1A and showing additional details thereof.

With reference to FIG. 2 wherein a representative module is shown, each color printing module of the printer apparatus includes a plurality of electrophotographic imaging subsystems for producing a single color toned image. Included in each module is a primary charging subsystem 210 for uniformly electrostatically charging a surface 206 of a photoconductive imaging member shown in the form of an imaging cylinder 205, an exposure subsystem 220 for image-wise modulating the uniform electrostatic charge by exposing the photoconductive imaging member to form a latent electrostatic color separation image in the respective color, a development station subsystem 225 for toning the image-wise exposed photoconductive imaging member with toner of the respective color, an intermediate transfer member 215 for transferring the respective color separation image from the photoconductive imaging member through a transfer nip 201 to the surface 216 of the intermediate transfer member 215 and from the intermediate transfer member to a receiver member (receiver member 236 shown prior to entry into the transfer nip 202 and receiver 237 shown subsequent to transfer of the toned color separation image) which receives the respective toned color separation images 238 in superposition to form a composite multi-color image thereon. The fifth module or printing station, M5, is substantially identical to the other modules except that it contains a similar type of toner, which is lacking a pigment.

Subsequent to transfer of the respective color separation images, one from each of the respective printing subsystems or modules, and transfer of the clear toner overcoat upon the multi-color image formed by the color separation images, the receiver member is advanced to a fusing subsystem 60 (FIG. 1B) to fuse or at least tack the multi-color toner image and the clear toner overcoat "image" to the receiver member. Additional members provided for control may be assembled about the various elements, such as for example a meter 211 for measuring the uniform electrostatic charge and a meter 212 for measuring the post-exposure surface potential within a patch area of a patch latent image formed from time to time in a non-image area on surface 206. Further details regarding the printer apparatus 100 are also provided in U.S. Pat. No. 6,608,641, issued on Aug. 19, 2003, by Peter S. Alexandrovich et al., the contents of which are incorporated herein by reference.

In an alternative embodiment, the image-recording member 205 can alternatively have the form of an endless web and the intermediate transfer member 215 may also be an endless web although it is preferred to be a compliant roller of well-known type. The exposure device may include an LED writer or laser writer or other electro-optical or optical recording element. Charging device 210 can be any suitable device for producing uniform pre-exposure potential on photoconductive image recording member 205, the charging device including any type of corona charger or roller charger. Any suitable cleaning device (not shown) may be associated with the surface 206 of the photoconductive image recording member, and another cleaning device (also not shown) may be associated with the surface 216 of the intermediate transfer member after respective transfer of the toned images there from. Still other forms of electrostatographic recording apparatus may be used to form the multi-color image and such apparatus need not have the color stations arranged in a tandem form as described herein.

Associated with each of the modules 200 is the logic and control unit (LCU) 230, which receives input signals from the various sensors associated with the printer apparatus and sends control signals to the chargers 210, the LED writers 220 and the development stations 225 of the modules. Each module may also have its own respective controller coupled to a main controller of the printer apparatus.

Subsequent to the transfer of the three, four, or more color toner separation images and the clear toner overcoat image in superposed relationship to each receiver member, the receiver member is then serially detacked from transport web 101 and sent in a direction indicated by arrow B (FIG. 1B) to a fusing station 60 to fuse or fix the dry toner images to the receiver member. The transport web is then reconditioned for reuse by cleaning and providing charge to both surfaces 124, 125 which neutralizes charge on the two surfaces of the transport web.

The electrostatic image is developed, preferably using the well-known discharged area development technique, by application of pigmented marking particles to the latent image bearing photoconductive drum by the respective development station 225 which development station preferably employs so-called "SPD" (Small Particle Development) developers. Each of the development stations is respectively electrically biased by a suitable respective voltage to develop the respective latent image, which voltage may be supplied by a power supply or by individual power supplies (not illustrated). Preferably, the respective developer is a two-component developer that includes toner marking particles and magnetic carrier particles. Each color development station has a particular color of pigmented toner marking particles associated respectively therewith for toning. Thus, each of the four modules, M1-M4 creates a series of different color marking particle images on the respective photographic drum. Alternatively, the developer may include a single component developer. It is also contemplated that the color toners may each be associated with a liquid developer. As will be discussed further below, a clear toner development station may be substituted for one of the pigmented developer stations so that the module M5 operates in similar manner to that of the other modules which deposit pigmented toner, however the development station of the clear toner module has toner particles associated respectively therewith that are similar to the toner marking particles of the color development stations but without the pigmented material incorporated within the toner binder.

With reference to FIG. 1B, transport belt 101 serially transports the toner image carrying receiver members toward a fusing or fixing assembly 60, which fixes or at least tacks the toner particles to the image substrate by the application of heat and pressure. More particularly, fusing station 60 includes a heated fusing roller 62 and an opposing pressure roller 64 that form a fusing nip 66 there between. Fusing station 60 also includes a release fluid application substation generally designated 68 that applies release fluid, such as, for example, silicone oil, to fusing roller 62.

The receiver member carrying the fused image (or at least tacked image) is transported from the fusing station 60 along a path to either a remote output tray 69 (when no clear toner overcoat is employed) or to a glossing station 70 (FIG. 3) if a clear toner overcoat is provided. In the embodiment shown, glossing station 70 is a stand-alone and/or off-line unit. However, it is to be understood that glossing station 70 can be alternatively configured as an integral and/or built-in station of the printer apparatus 100.

Figure 3:
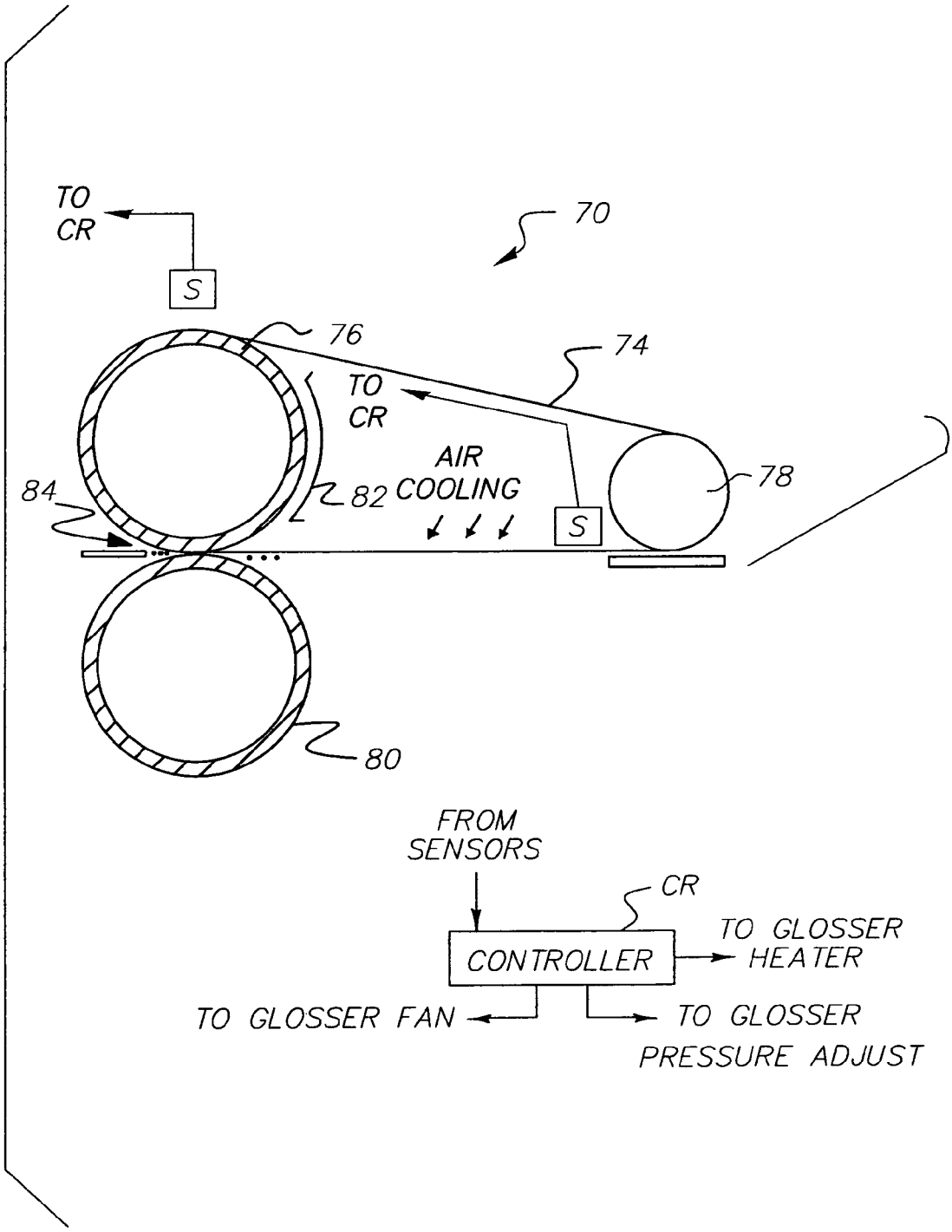
FIG. 3 is an illustration of a belt glosser apparatus that may be used in accordance with the invention.

With reference to FIG. 3, glossing station 70 includes a finishing or fusing belt 74, heated glossing roller 76, steering roller 78, pressure roller 80 and heat shield 82. Fusing belt 74 is entrained about glossing roller 76 and steering roller 78. The fusing belt 74 includes a release surface of an organic/inorganic glass or polymer of low surface energy, which minimizes adherence of toner to the belt. The surface may be formed of a silsesquioxane through a sol-gel process as described for the toner fusing belt disclosed in U.S. Pat. No. 5,778,295, issued on Jul. 7, 1998, by Jiann-Hsing Chen et al. Alternatively, the belt's release layer may be a poly (dimethylsiloxane) or a PDMS polymer of low surface energy, see in this regard, U.S. Pat. No. 6,567,641, issued on May 20, 2003, by Muhammed Aslam et al. Pressure roller 80 is opposed to, engages, and forms glossing nip 84 with heated glossing roller 76. Finishing belt 74 and the image substrate are cooled, such as, for example, by a flow of cooling air, upon exiting the nip 84 in order to reduce offset of the image to the finishing belt 74.

The logic and control unit (LCU) 230 includes a microprocessor and suitable tables and control software which is executable by the LCU. The control software is preferably stored in memory associated with the LCU. Sensors associated with the fusing and glossing stations provide appropriate signals to the LCU when the glosser is integrated with the printing apparatus. In any event, the glosser can have separate controls providing control over temperature of the glossing roller and the downstream cooling of the belt and control of glossing nip pressure. In response to the sensors, the LCU issues command and control signals that adjust the heat and/or pressure within fusing nip 66 (FIG. 1B) so as to reduce image artifacts which are attributable to and/or are the result of release fluid disposed upon and/or impregnating image substrate that is subsequently processed by/through glossing station 70, and otherwise generally nominalizes and/or optimizes the operating parameters of fusing station 60 for imaging substrates that are not subsequently processed by/through glossing station 70.

Figure 6:
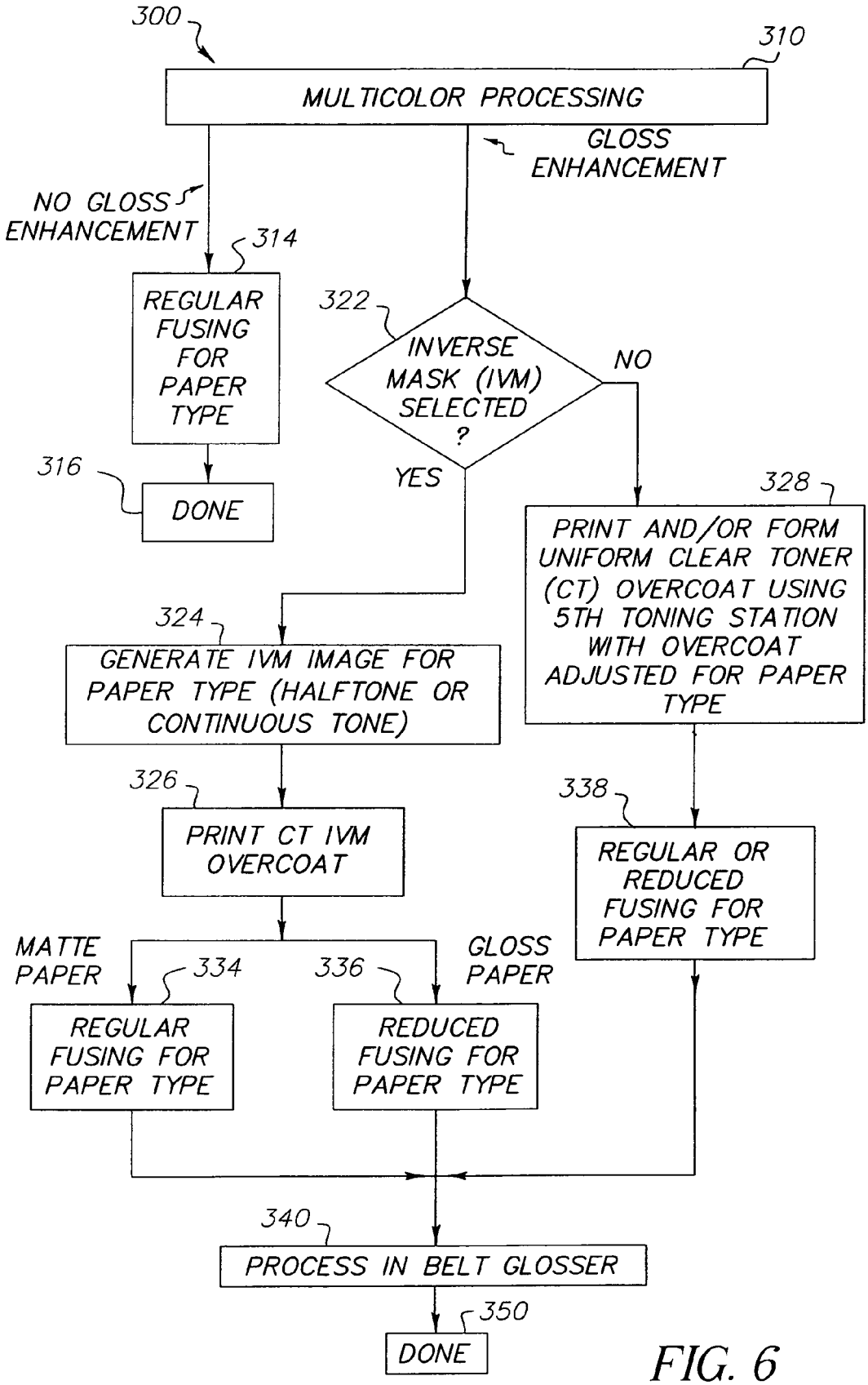
FIG. 6 is a flowchart illustrating operation of the apparatus of FIGS. 1 through 3 in accordance with the method of the invention.

With reference now to the flowchart 300 of FIG. 6, the assumption is that a four-color multi-color image is to be formed on a receiver substrate, step 310. However, as noted above the invention contemplates that three, four, five, or more colors of toners may be combined to form the multi-color image. Through a single pass of the receiver member through the four color printing stations, M1-M4 of printing apparatus 100 a receiver member in the form of a sheet, which may be of a paper, plastic, coated metal or a textile material, receives four-color toner separation images formed thereon. Subsequent processing of the imaged receiver member is dependent upon whether or not the operator has input via an input device such as a computer terminal or other operator input device a request for subsequent glossing treatment. Where no glossing treatment or enhancement is requested regular fusing of the four-color image is performed by fuser station 60, step 314, in accordance with the requirements of the receiver type. Typically, the parameters for nominal fusing of a typical receiver such as paper will be dependent upon the thickness and/or weight of the paper and its surface characteristics, such as manufactured gloss finish or matte finish. Subsequent to fusing the image formed on the surface is complete, step 316, and no further processing of this receiver is required, except for perhaps forming another image on the opposite surface, i.e. duplex formation, which is a standard practice and need not be discussed further herein. No clear toner need be provided by the clear toner printing station M5.

In order to provide for a glossing treatment or gloss enhancement, the fifth toner printing station or module M5 is provided with a clear toner (CT) development station. This development station may contain a coding that is automatically sensed by the printer apparatus so that processing conditions for using the clear toner are automatically established.

If a gloss enhancement of a print is selected, a determination is made in step 322 as to whether or not an inverse mask (IVM) is selected. In lieu of providing a uniform application of clear toner to cover the entire image area, it is provided to reduce the amount of clear toner by application of an inverse mask (IVM) wherein one lays down more clear toner in areas that have less color toner coverage. In this IVM mode, balance is created in toner stack heights by providing relatively greater amounts of clear toner coverage to areas of an image having relatively lower amounts of color toner coverage and lesser amounts of clear toner coverage to areas of the image having relatively greater amounts of color toner coverage. In this regard reference is made to U.S. Pat. No. 5,234,783, issued on Aug. 10, 1993, by Yee S. Ng. However, as may be seen with reference to the graph shown in FIG. 4, an unexpected improvement in color gamut can be obtained with the use of the inverse mask and belt gloss enhancement.

Figure 4:
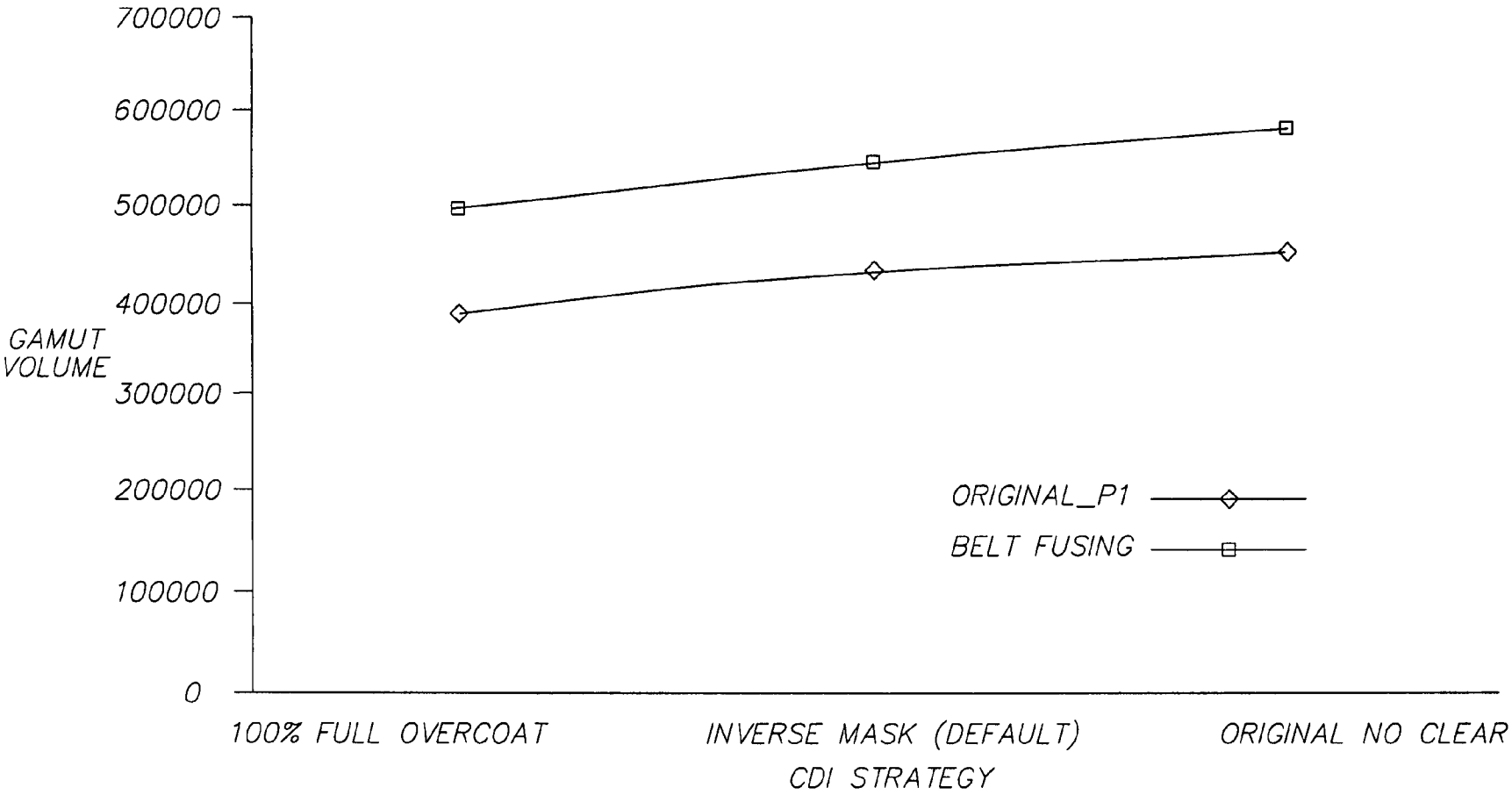
FIG. 4 is a graph showing formation of a multi-color electrophotographic image in accordance with different treatments involving use of a clear toner overcoat including no overcoat.

In FIG. 4, various strategies of clear dry ink (CDI) or clear toner (CT) are illustrated along with the respective color gamut volume achieved. In the example of the use of 100% full overcoat, it can be seen that a multi-color image subject to regular fusing but no gloss enhancement had a significantly lower color gamut volume than a similarly produced multi-color image having a 100% full overcoat of clear toner applied but subjected to reduced fusing and then subjected to gloss enhancement by a belt fuser. However, it will be noted that a multi-colored image having no clear toner overcoat but subjected to regular fusing had a significantly lower color gamut volume than a similar multi-colored image having no clear toner overcoat but subjected to a reduced fusing condition and then belt fusing. In the case of a multi-colored image that is covered with clear toner using an inverse mask but subjected to a reduced fusing condition and then belt fusing for gloss enhancement, it was unexpectedly noted that significant improvement in color gamut is obtained relative to the case of the multi-colored image also having clear toner using an inverse mask but being subjected to regular fusing and no belt fusing. What is particularly interesting is that the provision of the print with clear toner using an inverse mask (IVM) and belt fusing and/or glossing can provide not only the protection afforded by the presence of the clear overcoat in the abrasion vulnerable regions of the multi-colored image but a meaningful improvement in color gamut obtained over that of the case where a similar color toner image is formed on a similar receiver but using a 100% full uniform overcoat of clear toner is provided. In some cases with the use of the IVM for the clear toner with belt fusing and/or glossing upon a multi-color toner image, there may also be an improved color gamut provided over that of the case of a similar multi-color image formed upon a similar receiver but receiving no clear toner overcoat and no belt glossing.

Figure 5:
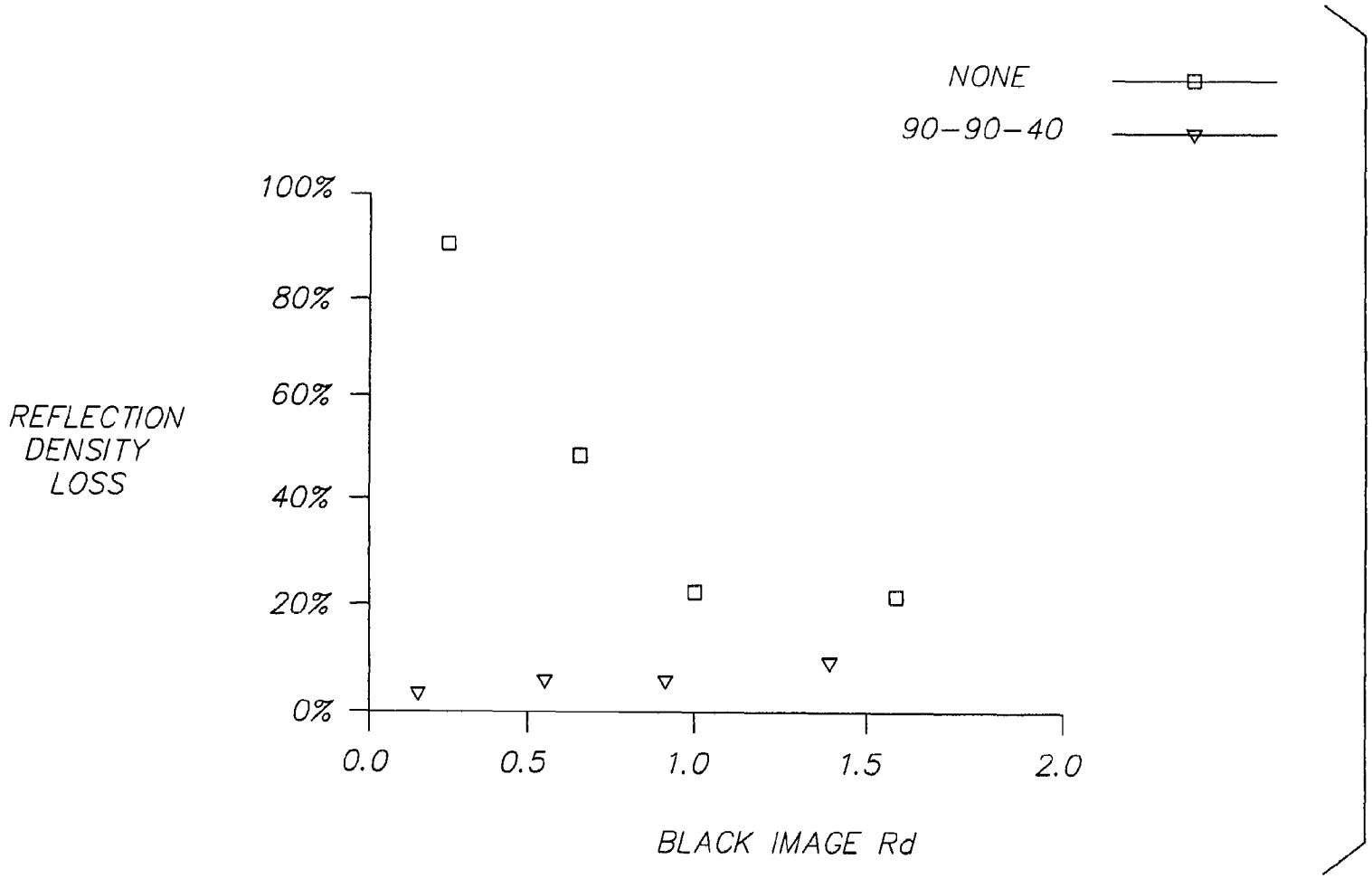
FIG. 5 is a graph illustrating abrasion resistance relative to density of a toner image.

With reference to FIG. 5, there is illustrated the results of a test performed on a black image wherein abrasion results are compared between a print having no clear toner overcoat and a print having an inverse mask clear toner overcoat, and in particular, one referred to below (see FIG. 8) as a 90-90-40 inverse mask. The results of this test demonstrates that abrasion of the print not having a clear toner overcoat creates more significant reflection density loss in the highlight areas of the print. The nature of the inverse mask is to provide significantly more toner in the highlight region, which is shown to significantly reduce abrasion in this vulnerable region and yet provides the improvement of color gamut volume over the case of a 100% or uniform clear toner coverage.

The controller (LCU 230) of the printer apparatus may be programmed so as to be operative, for example by selection by the operator, to process the printing of a clear toner image in accordance with plural selectable modes so that some prints may be formed that are uniformly covered with clear toner and other prints may be formed with the clear toner deposited or printed in an IVM mode wherein balance is achieved in toner stack heights. Further details regarding the IVM mode are provided below.

Where an overall uniform clear toner overcoat is selected, step 322 (FIG. 6), the electro-optical recording element associated with the fifth image forming module M5 may be enabled in accordance with the information for establishing or printing an overall uniform coat in clear toner. Image data may be developed in accordance with paper type and the pixel-by-pixel locations suitably discharged or the electrostatic charge on the photoconductive surface of the imaging cylinder suitably reduced in the entire area where discharge area development is employed. More preferably, the electro-optical writer may be disabled and the uniform charger and clear toner development station electrical bias adjusted to provide a charge suitable for developing on the imaging cylinder an overall clear toner in the image area, by the clear toner development station, of a thickness suited for the receiver type, step 328. Where glossing treatment is desired subsequent to four-color or multi-color processing in step 310 and the uniform clear toner overcoat provided in step 328, either regular or reduced fusing for this paper type is provided for, step 338. The term regular fusing implies that similar conditions, e.g. temperature and pressure, for fusing a multi-color image is provided for in this step as would be the case for fusing of a similar receiver sheet having a similar multi-color image formed thereon and which is not to receive a glossing treatment. The term reduced fusing implies that the fusing parameters or conditions are adjusted to a reduced level from that of regular fusing and this term may also contemplate that the reduced fusing imparts merely a tacking of the toner particles to each other as well as contemplating reduced levels of fusing.

Where the IVM is selected, the electro-optical recording element associated with the fifth image-forming module M5 is enabled in accordance with the information for establishing or printing an inverse mask in clear toner. Image data for the clear toner IVM is developed in accordance with paper type and the pixel-by-pixel locations as to where to apply the clear toner, step 324. Information regarding the multi-color image is analyzed by a raster image processor 501 (RIP see FIG. 7) associated with the logic and control unit 230 to establish, on a pixel-by-pixel basis, as to where pigmented toner is located on the multi-color printed receiver. Pixel locations having relatively large amounts of pigmented toner are designated as pixel locations to receive a corresponding lesser amount of clear toner so as to balance the overall height of pixel locations with combinations of pigmented toner and clear toner. Thus, pixel locations having relatively low amounts of pigmented toner are provided with correspondingly greater amounts of clear toner (CT), step 326. With reference to FIG. 8, there are illustrated exemplary graphs illustrating various inverse masks providing a relationship relative to amounts of clear toner to be deposited at pixel locations versus amounts of pigmented toner in the multi-color image at the corresponding pixel location using one of the inverse masks illustrated. In the printing of the clear toner as an inverse mask, the inverse mask image data may be processed either as a halftone or continuous tone image. In the case of processing this image as a halftone a suitable screen angle may be provided for this image to reduce moiré patterns.

Where glossing treatment is desired and assuming the receiver type is a matte paper, subsequent to four color or multi-color printing in step 310 and printing of the clear toner overcoat in the form of an inverse mask image in step 326 formed by a single pass through the tandemly arranged image forming modules M1-M5, regular or nominal fusing for this paper type is provided for, step 334. As defined above the term regular or nominal fusing implies that substantially similar conditions, e.g. temperature and pressure, for fusing a multi-color image is provided for in this step as would be the case for fusing of a similar receiver sheet having a similar multi-color image formed thereon and which is not to receive a glossing treatment.

In the event that the receiver type employed is a glossy paper, the four color multi-color printing and printing of the clear toner overcoat in the form of an inverse mask in step 326 formed by a single pass through the image forming modules M1-M5 are preferably subjected to a reduced fusing processing, step 336, for this paper type wherein the fuser is adjusted to a reduced temperature and/or pressure (such as increased nip width) from a nominal setting established for this paper type for fusing a similar multi-color image that is not to be subject to a further glossing step. However, some improvement in color gamut and gloss may be realized in accordance with the invention even though a reduced fusing condition is not used for the glossy paper. This reduces the need for switching fusing conditions with respect to whether or not clear toner is to be applied to the multi-colored image.

In step 340, the receiver with the clear toner overcoat, whether it is through an inverse mask printing or uniform over coating, is processed in the belt glosser to complete the fusing of the clear toner overcoat in the multi-color image to the receiver.

The inverse mask preferably is adjusted for the type of paper receiver as will be described below. Additionally, the amount of uniform clear toner overcoat provided, where that mode is selected, may also be adjusted for the type of paper receiver. The fusing conditions and the conditions of the belt glosser are also adjusted for the type of receiver.

As noted in commonly assigned U.S. patent application Ser. No. 10/933,986, filed on Sep. 3, 2004, by Yee S. Ng, a third mode may also be provided wherein back-transfer artifacts are reduced or eliminated without the need or expense of providing uniform coverage of clear toner to the print wherein a five color tandem printer is used to print fewer than five colors. In this third mode, the fifth station may be used during the one pass through the printer apparatus, as a clear toner station, to deposit more clear toner in relatively higher colored areas and less clear toner in areas having relatively lower amounts of colored toner.

Figure 7:
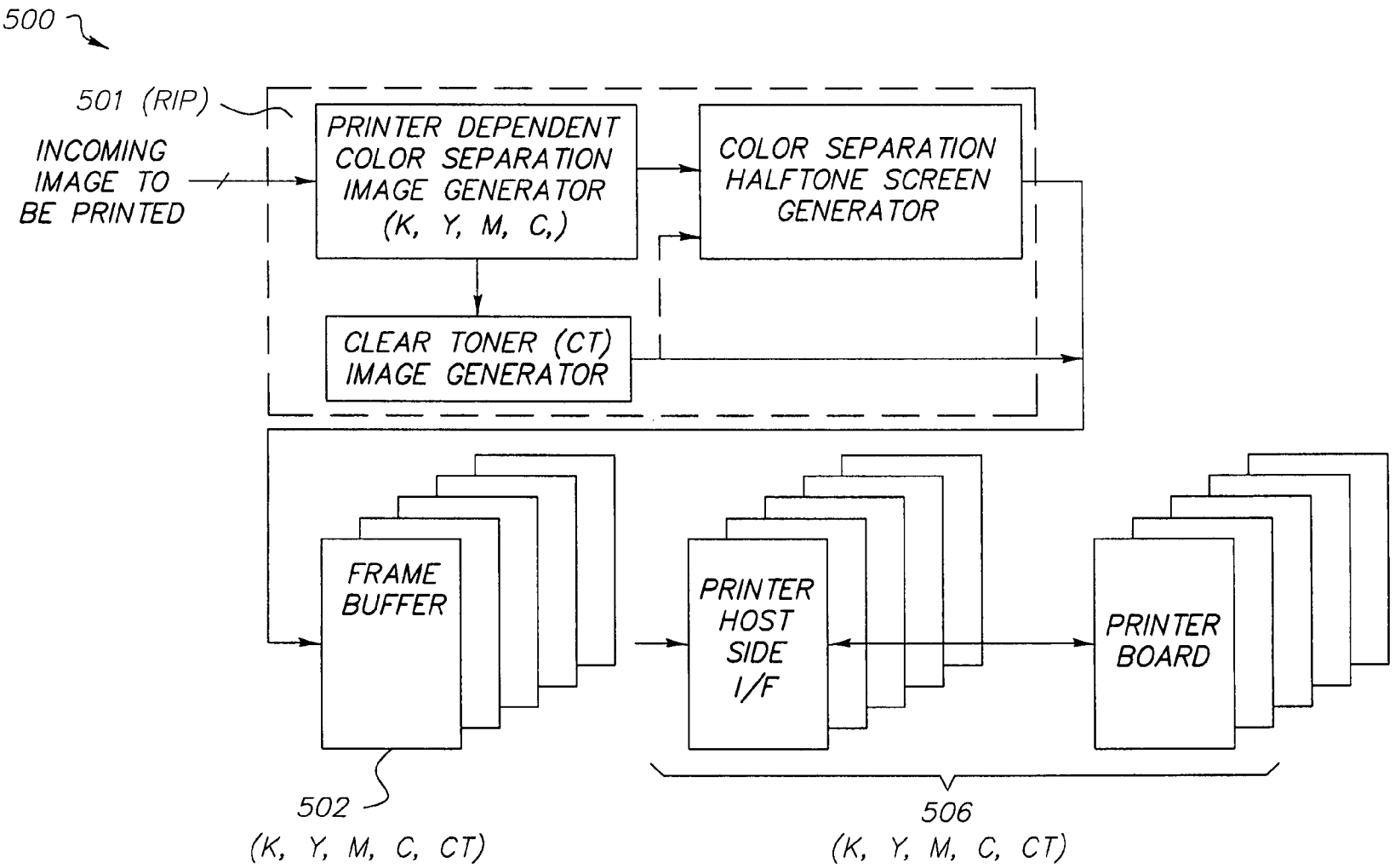
FIG. 7 is a schematic of an image processing system for providing image data to color and clear toner printing stations of the apparatus of FIGS. 1A and 1B in accordance with the invention.
Figure 8:
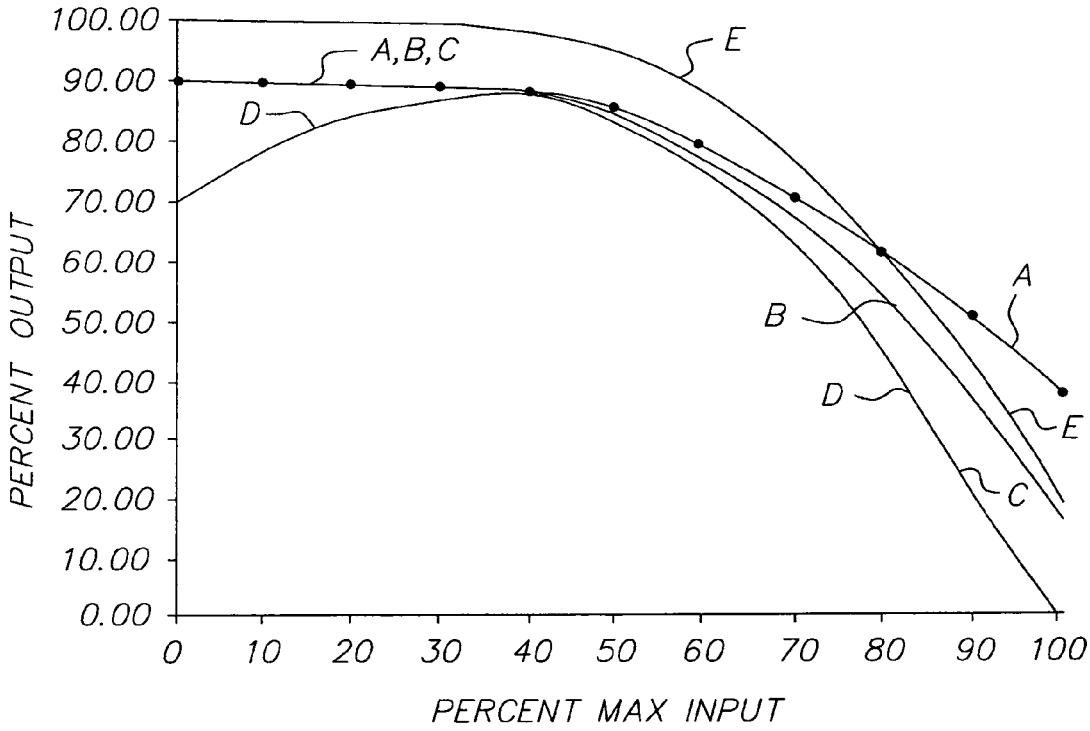
FIG. 8 includes exemplary graphs illustrating amounts of clear toner to be deposited at pixel locations versus amounts of pigmented toner in a multi-color image using an inverse mask for depositing the clear toner as an overcoat.

With reference now to FIG. 7, image data for writing by the printer apparatus 500 may be processed by a raster image processor (RIP) 501 which may include a color separation screen generator or generators. The output of the RIP may be stored in frame or line buffers 502 for transmission of the color separation print data to each of the respective LED writers 506 K, Y, M, and C (which stand for black, yellow, magenta, and cyan respectively). The RIP and/or color separation screen generator may be a part of the printer apparatus or remote there from. Image data processed by the RIP may be obtained from a color document scanner or a digital camera. Such data may alternatively be generated by a computer or from a memory or network, which typically includes image data representing a continuous image that needs to be reprocessed into halftone image data in order to be adequately represented by the printer. The RIP may perform image-processing processes, including color correction, in order to obtain the desired color print. Color image data is separated into the respective colors and converted by the RIP to halftone dot image data in the respective color using threshold matrices, which have desired screen angles and screen rulings. The RIP may be a suitably programmed computer and/or logic device, and is adapted to employ stored or generated threshold matrices and templates for processing separated color image data into rendered image data in the form of halftone information suitable for printing.

With continued reference to FIG. 7, incoming image data to be printed is input to the RIP 501 and converted to printer dependent color separation image data in each of the four-color images printed by the printer apparatus 100. The clear toner image generator, which also may be a part of the RIP, creates a clear toner "image" from the four color separation images previously created, as will be further described in more detail below, assuming that glossing is to be done and an inverse mask is to be established for printing of the clear toner. Halftone screen generators may also form a part of the RIP and convert each of the four-color separation images into color separation halftone screened images. Additionally, the halftone screen generators may also convert the clear toner "image" into a halftone screen pattern (see dashed line) of image information, or alternatively (see full-line), the clear toner whether printed as an inverse mask or uniform overcoat may be established using continuous tone and not halftone printing. The image data from each of the four halftone screened color separation images and clear toner halftone screen separation image are output to frame buffers 502 K, Y, M, C, and CT respectively from which they are sent to a printer host side interface. A printer board communicates with the printer host side interface and includes supporting circuitry for outputting corrected image information for printing by each of the respective writers 506 K, Y, M, C, and CT with appropriate synchronization. The clear toner (CT) image for the IVM overcoat is determined as will be described below and printed using the fifth printer module M5.

With reference now also to FIG. 8, an example of a general relationship between density of a color image at a particular pixel location or image area and a preferred amount of clear toner to be applied to the area as an inverse mask is shown. As may be noted from the graph "A" a 90% coverage level of clear toner or clear dry ink (CDI) is employed at pixel locations or image areas where color separation image percent is from 0% to 40%, i.e. the highlight region to the mid-tone region. For pixel locations or image areas where color separation image percent is greater than 40%, the mid-tone ranges through to the shadow region where toner buildup is greatest, there is a generally a gentle roll off providing a progressive decrease in percent of clear toner laid down with increases of color density or color separation image coverage. The generation of the "image" map for depositing the clear toner is generated for each pixel location for the clear toner "image." The generated image-map for the clear toner image may be subjected to processing through a halftone screen generator or instead be of a continuous tone. The halftone screen generated image information for each the five color separation images and the image data for the clear toner image are modified to printer dependent image data and stored in frame buffers 502 (FIG. 7). The printer image data may also provide for correction for nonuniformities of the recording elements and/or other correction information, or more preferably this can be provided on the printer board. In accordance with well known techniques for printing the information stored in the frame buffers, the information is output at suitably synchronized times for imaging of the respective electrostatic color separation images during the single pass by the respective writers as described above. As a convenience in calculation, rather than determining pigmented toner coverage at any pixel area in accordance with the sum of the four color contributions at that pixel location, one may select the maximum pixel percent contribution by a color separation at that pixel location as the percentage of pigmented toner coverage present at that location for use in determining the amount of clear toner overcoat to be applied in the inverse mask in accordance with the graph of FIG. 8. The use of the single color that is maximum at that location in conjunction with the particular selected IVM curve's roll off starting at the mid-tone helps ensure that total toner coverage of the four colors plus clear toner at the pixel location is below 320%, and this is basically true for the entire color gamut. As a further convenience in calculation, in lieu of making such calculation for the inverse mask using a pixel by pixel calculation, one may group local areas of say 4×4 pixels or 16 pixels to determine the amount of clear toner in the inverse mask calculation for this small area formed by a group of pixels.

The specific IVM masks illustrated in FIG. 8 are merely exemplary. The IVM mask illustrated by curve "A" and described above may be referred to as a 90/90/40 mask illustrating the relationship from the highlight region to the mid-tone region and then with a gradual roll off in the mid-tone region to the shadow region. The IVM mask illustrated by curve "B" may be referred to as a 90/90/20 IVM mask. The IVM mask illustrated by curve "C" may be referred to as a 90/90/00 IVM mask. The IVM mask illustrated by curve "D" may be referred to as a 70/90/00 IVM mask. This latter mask conserves on clear toner use in the highlight region.

The use of an IVM mask that employs less than 100% clear toner coverage at the highlight region to the mid-tone region, for example only 70% to 90% coverage, not only provides for conserving, and not overusing of clear toner, but also provides for reducing the negative impact on color gamut when clear toner overlies the colors. Thus, not only cost savings are realized but also, an additional advantage of color gamut maintenance is obtained. In considering percentage coverage, 100% coverage by the clear toner implies a representative small area is totally covered with clear toner while for example 90% coverage implies that only 90% of the small area is covered. This can be done using half-toning algorithms.

Other IVM masks more suited to matte type receivers or uncoated receivers may have an IVM mask providing greater amounts of clear toner in the highlight area. For example, for such papers a 100/100/20 IVM mask (curve "E") might be used, it being understood that this refers to percentages of actual lay down of clear toner instead of differences in exposure setting for the writer that is used to "write" the clear toner image or inverse mask. The higher level for the IVM mask for the matte or uncoated receivers appears to provide for reduction of pinhole artifacts. The IVM mask curve may be optimized to reduce gamut loss and may be variable in accordance with substrate used for the receiver sheet or process stability or Q/M. The roll off at mid-tone ensures that there will be less loss of color gamut in the mid-tone (the place where color gamut is most affected by overlying clear toner), but provides sufficient protection at the highlights areas of the color image. The roll off at mid-tone further ensures that that the total toner coverage with the five toners (including clear) at any pixel location is below 320% toner coverage level. In this regard, wherein there is input or sensing of one or more of the factors including receiver type, electrostatographic process conditions including sensing of, or determination of, toner charge to mass, and toner type, in response, a suitable IVM mask is selected in accordance with the appropriate conditions.

Figure 9:
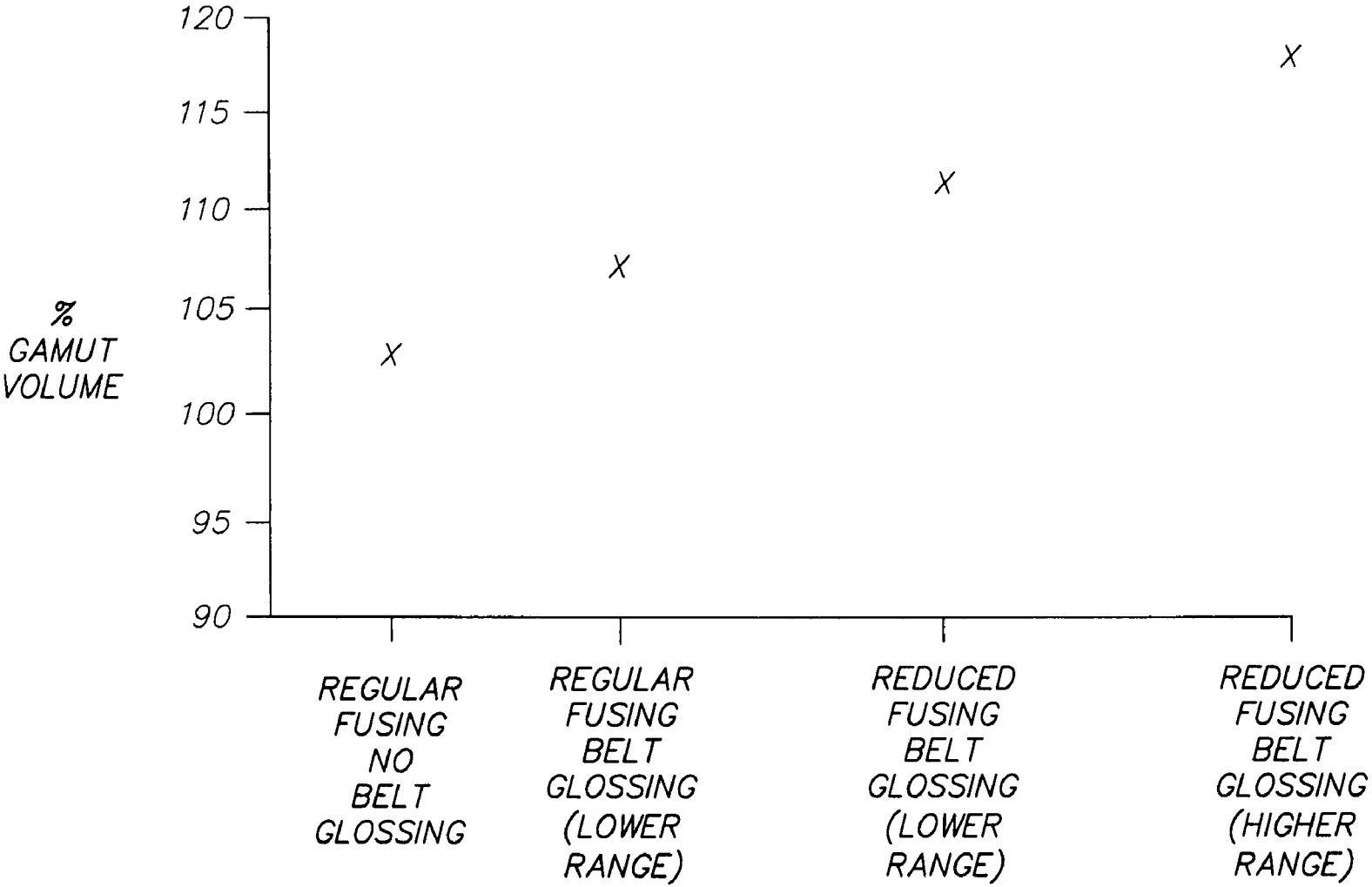
FIG. 9 is a graph illustrating that gamut volumes are found to be different for different fusing and belt glossing processing conditions when forming multi-color prints.

In an example of employing parameters suitable for an application of the invention with a Lustro Gloss paper receiver having a glossy coating thereon, the NexPress 2100 color printer with five printing stations or modules may be used to form a multi-color image on this receiver and then subject to regular fusing parameters of temperature and pressure (nip width). The paperweight is 118 g/m$^2$, with a Sheffield smoothness of about 10. In forming the clear toner "image", an IVM mask of 70/90/00 halftone may be used. With reference to FIG. 9, various combinations of fusing conditions and belt glossing may be used to examine the effect upon gamut volume. As may be seen in FIG. 9, where regular fusing for this type of paper is used with no belt glossing, the gamut volume is the lowest shown. Some improvement in gamut volume is achieved by adding belt glossing, using a belt having a release layer formed by a sol-gel process, and a relatively lower range of belt temperature of 140° C. and nip width of 25 mm but still using the regular fusing parameters for this paper. Still further improvement in gamut volume is realized by using a reduced fusing condition or set of parameters from that of the regular fusing parameters for this paper but retaining the belt glossing parameters in the lower range. The greatest realizing of increase in gamut volume is obtained by employing the reduced fusing condition or set of parameters in conjunction with belt glossing at a higher range, for example 160° C. with a nip pressure providing a nip width of 35 mm. This last embodiment appears to provide almost a 17% increase in gamut volume from that of the first example where regular fusing is provided but no belt glossing is done.

The invention thus provides for the increase in gamut volume through the use of an inverse mask mode for printing of a clear toner overcoat upon a multi-color image, wherein a reduced fusing condition is employed to at least tack the overcoat and a multi-color image and then is followed by belt glossing. Balance is created in toner stack heights by providing relatively greater amounts of clear toner coverage to areas of an image having relatively lower amounts of color toner coverage, and lesser amounts of clear toner coverage to areas of the image having relatively greater amounts of color toner coverage. Differential gloss is thus reduced and problems of toner abrasion avoided particularly in the most vulnerable regions; i.e. the highlight regions. The controller for the printer, which preferably includes a computer, may be programmed so as to be operative, for example by selection by the operator, to process the printing of an image in accordance with anyone of the three selectable modes. Some prints may be formed that are uniformly covered with clear toner, other prints may be formed in accordance with the aforesaid third mode wherein back-transfer artifacts are reduced or eliminated when less than five colors are used to produce a multi-color image in a five color station tandem printer and without the need to (and expense of) providing uniform coverage of clear toner to the print, and still other prints may be formed in accordance with the noted second mode wherein balance is achieved in toner stack heights using the inverse mask in a multi-color image.

Although the invention has been described in terms of forming of multi-color images, the inverse masks described herein are quite suited to be useful for the forming of prints in a single color such as black toner pigment on for example a white receiver wherein the protections afforded by the inverse mask overcoat and gloss enhancement by the belt glosser as described herein are advantageously obtained.

Figure 12:
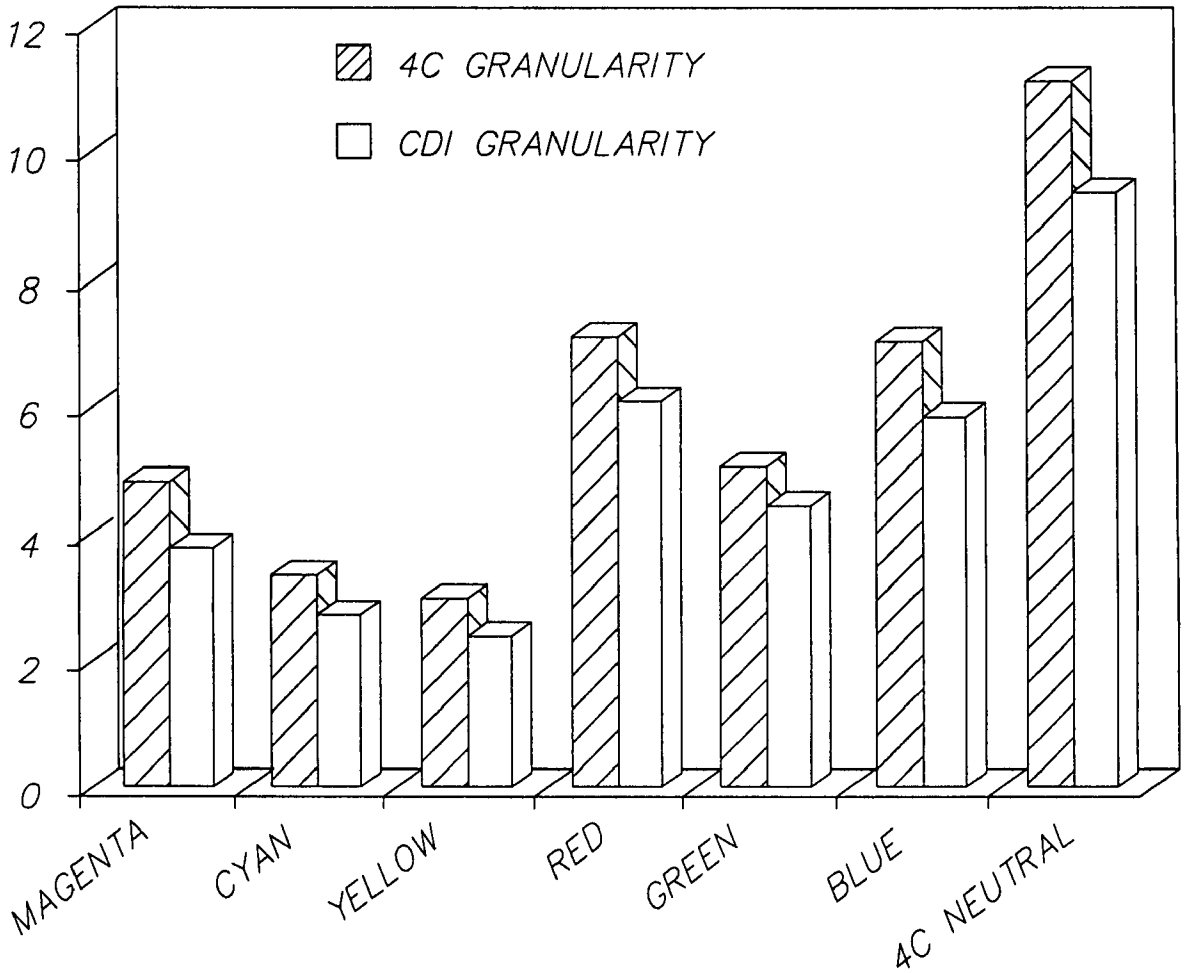
FIG. 12 is a graph illustrating granularity differences between color images formed on the same printer apparatus using a color process without a clear toner overcoat and a color process using a clear toner overcoat with an inverse mask.

In accordance with the invention, it has also been noted that the use of the inverse mask with the clear dry toner having a gentle roll off in the mid-tone region provides for a reduced granularity when compared with a similar image even though not subjected to belt glossing. In this regard, reference may be had to FIG. 12 wherein granularity (deltaE) in the uniform color space for a typical four color image versus a four color image and with clear dry toner wherein a 90/90/40 clear toner inverse mask is used for image protection. The graph illustrates a reduction in granularity especially in the highlight and mid-tone regions for the color image over coated with the clear toner in the form of an inverse mask.

Although the invention has been described in terms of a printer apparatus having five stations with one of the stations being assigned to provide the IVM clear toner overcoat to the multi-color image and then belt glossing the clear toner over coated multi-color image, it will be understood that the glossing apparatus may be provided with a clear toner applicator located at the output of the fusing station of the printer apparatus (FIG. 1). Thus additional color stations may be provided for in the printer apparatus to form multi-color images having more than four colors and thus the printer apparatus may be said to be adapted to form at least a pentachrome color image. In addition the multi-color images may be formed using inkjet, thermal or other printing technology instead of electrostatographic reproduction as described herein.

Figure 10:
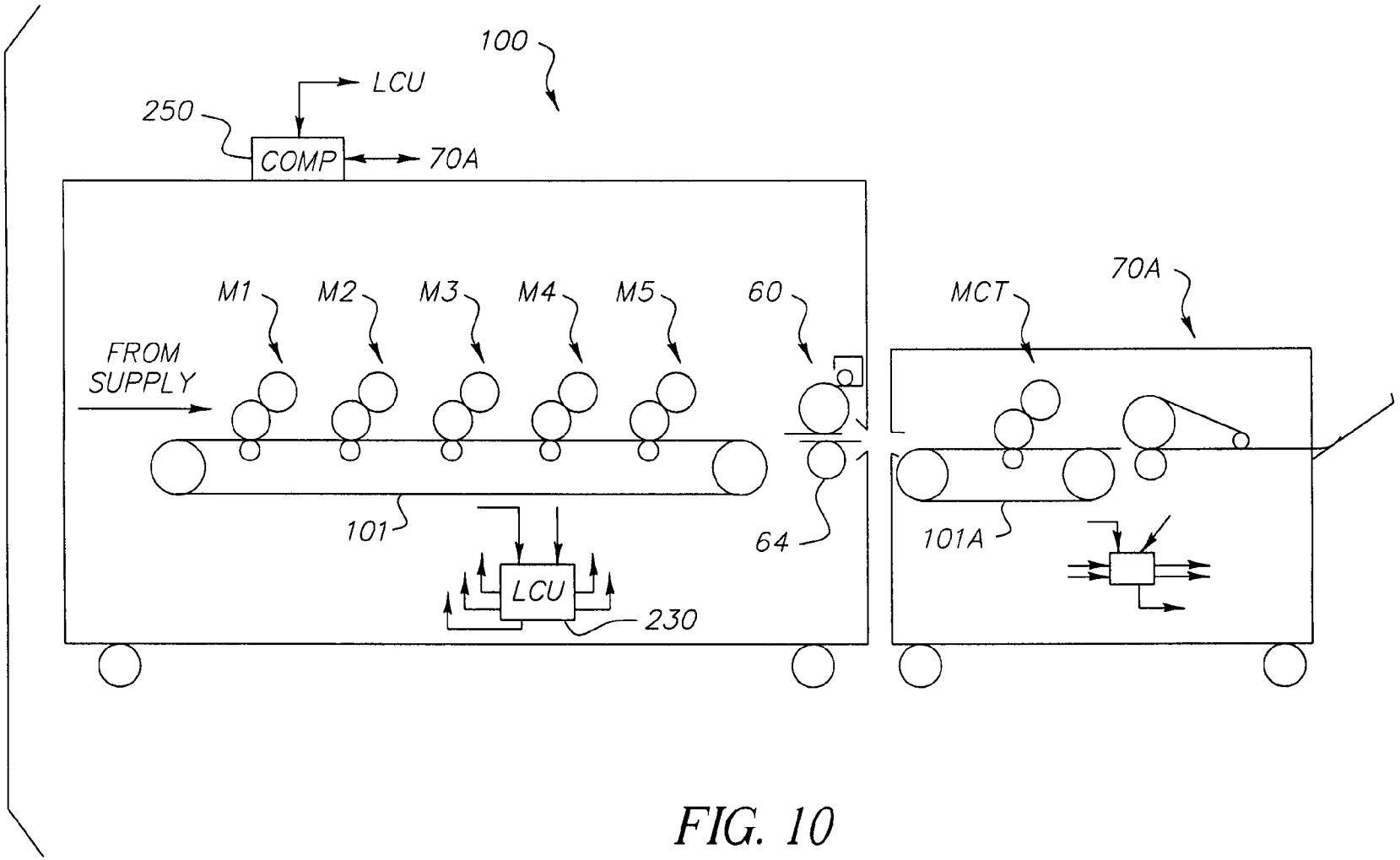
FIG. 10 is a schematic of an alternative apparatus embodiment of the invention.

In such an example and with reference to FIG. 10, a finished multi-color image with enhanced gloss can be provided in a single pass by forming the multi-color image in the printing apparatus 100. The multi-color image is subjected to a reduced fusing step by passing the receiver within the fusing rollers of fusing assembly 60, and applying heat and pressure to the receiver with the multi-color image formed thereon to fuse or at least tack the multi-color toner image to the receiver. Subsequent to such at least tacking the receiver is passed to a glossing station having a clear toner over coating station so that the clear toner is applied over the fused multi-color toner image either as a uniform overcoat, or preferably as described above, as an inverse mask applied overcoat. The over-coated multi-color toner image is the subjected to gloss enhancement in the belt glosser 70A.

The at least pentachrome image includes an image formed from at least five distinct color ink pigments that combine to form a color gamut. Examples of such pigmented combinations forming a multi-color image, and which examples should not be considered limiting, include: CMYK+Red, CMYK+Blue, CMYK+Green, CMYK+Orange, CMYK+Violet, and CMYK+Red+Blue+Green. Still other alternatives include substituting the black toner used in one of the toner printing modules or printing stations of printer apparatus 100 with toner of another color.

Figure 11:
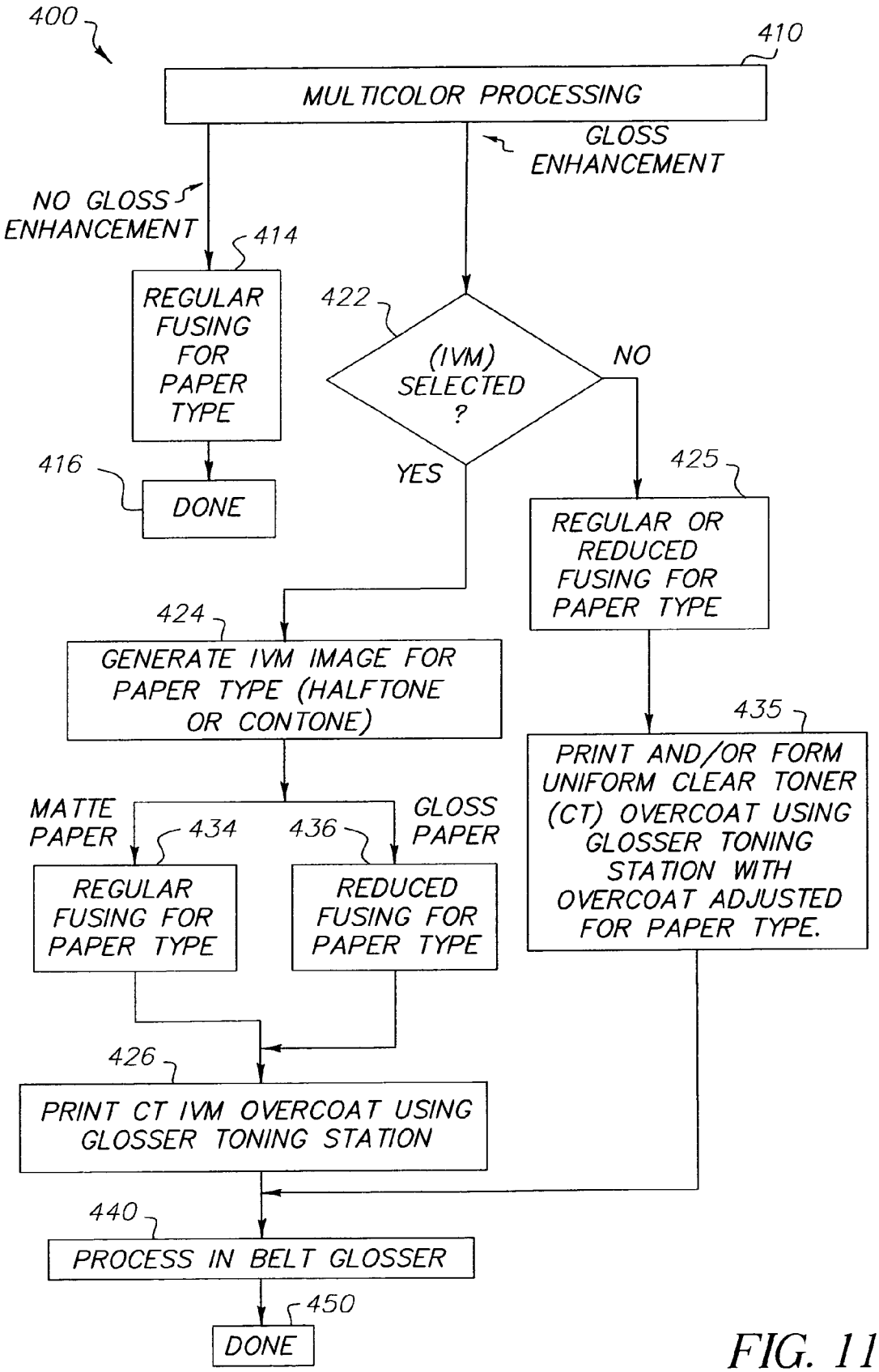
FIG. 11 is a flowchart illustrating operation of the apparatus of FIG. 10.

With reference to the alternative embodiment illustrated in FIG. 10 and the flowchart 400 of FIG. 11, a five module electrostatographic printer apparatus similar to that described above with reference to FIGS. 1A and 1B is positioned adjacent a gloss enhancement apparatus 70A. The printing modules M1-M5 are provided with respective different color toners to provide a three, four or five color multi-color image on a receiver sheet passing through the printing stations while being supported on the transport belt or web 101. The description above relative to the printer apparatus 100 and the different combinations of toner colors employed to create a printed multi-color image are pertinent to the description of the embodiment of FIG. 10. After creation of the multi-color image on the receiver sheet, step 410, the receiver sheet enters the fusing assembly 60 and the multi-color image is fused or at least tacked to the receiver sheet as it exits the printer apparatus 100. The fusing or at least tacking process may be either a reduced fusing or regular fusing for the particular type of receiver as described above, steps 434, 436, and 435. In step 422, a determination is made as to whether or not an inverse mask is selected. If no gloss enhancement is to be provided, regular fusing will be provided in step 414 and the printing of the multi-color image is done step 416. However, if gloss enhancement is to be provided, the receiver is caused to enter the glossing station 70A wherein it is subjected to an overcoat that is either uniform or has a printed inverse mask clear toner overcoat. The gloss enhancement apparatus 70A includes a clear toner-printing module MCT that may be similar to one of the modules M1-M5 and may be provided with a transport belt 101A. A computer controller 250 may receive image data from a network or terminal or other image data input device, and input this data to a logic and control unit LCU 230 of the printer apparatus 100 and to the clear toner printing module MCT for creation of an inverse mask, step 424, in accordance with signals sent from this terminal to a controller associated with the gloss enhancement apparatus 70A. Alternatively, the clear toner-printing module MCT may be used to provide a uniform overcoat layer to the multi-color image, step 435. Whether the clear toner printing module MCT prints an inverse mask clear toner overcoat, step 426, or provides a uniform clear toner overcoat, the characteristics of this clear toner overcoat may be adjusted for the type of receiver as has been described above. In this regard, memory in one or more of the controllers may contain tables providing fusing and clear toner characteristics to be provided for possible receivers to be processed by the printer apparatus 100 and the gloss enhancement apparatus 70A having a belt glosser as described previously. Thus, for example, for matte type papers, regular fusing for this paper type may be provided, step 434 and 435. For gloss papers, reduced fusing or at least tacking of the multi-color image may be provided for before entry into the belt-glossing portion of the glossing apparatus 70A, steps 435 and 436. Subsequent to placement of the clear toner overcoat upon the multi-color print by the module MCT, the over coated multi-color print then enters the glosser as described above for gloss enhancement treatment, step 440 and the print is formed, step 450. The clear toner may be deposited in accordance with a continuous tone or a halftone.

There has thus been shown an improved printer apparatus and method of printing wherein color images may be provided with a clear toner overcoat to protect vulnerable areas from abrasion, and provide for minimization of artifacts such as differential gloss, and unexpectedly provide improved color gamut relative to uniformly over coated prints.

The invention has been described in detail with particular reference to certain preferred embodiments thereof, but it will be understood that variations and modifications can be effected within the spirit and scope of the invention.

The invention claimed is:

1. A method of forming a multi-color image on a receiver comprising:

forming a multi-color toner image, on a receiver, with toners of at least three different colors of toner pigments which form various combinations of color at different pixel locations on the receiver to form the multi-color toner image thereon;

forming a clear toner overcoat upon the multi-color toner image, the clear toner overcoat being deposited as an inverse mask;

pre-fusing the multi-color toner image and clear toner overcoat to the receiver to at least tack the toners forming the multi-color toner image and the clear toner overcoat; and fusing the clear toner overcoat and the multi-color toner image using a belt fuser to fix the clear toner overcoat to the receiver and/or provide an improved gloss to the multi-color toner image.

2. The method of claim 1 wherein, in the pre-fusing step, operating parameters of a fuser station are adjusted to provide a reduced fusing condition in the pre-fusing step relative to a fusing condition employed by the fuser station for fusing a multi-color image formed on a similar receiver but which is not to be provided with a clear toner overcoat.

3. The method of claim 2 wherein, in response to an input of receiver type and whether or not a clear toner overcoat is to be provided, signals from a controller are provided for adjustment of operating parameters of the fuser station.

4. The method of the claim 3 wherein the clear toner overcoat is deposited onto the multi-color image in the form of a halftone.

5. The method of claim 3 wherein the clear toner overcoat is deposited onto the multi-color image in the form of a continuous tone.

6. The method of the claim 1 wherein the clear toner overcoat is deposited onto the multi-color image in the form of a halftone.

7. The method of claim 1 wherein the multi-color toner image is formed by a tandem electrostatographic printer where the receiver is passed through a series of color separation image forming stations and each station deposits a respective color separation image to the receiver.

8. The method of claim 7 wherein, the clear toner is deposited onto the multi-color image by passing the receiver through a clear toner image forming station which deposits the clear toner in the form of an inverse mask.

9. The method of claim 8 wherein in the pre-fusing step, operating parameters of a fuser station are adjusted to provide a reduced fusing condition in the pre-fusing step relative to a fusing condition employed by the fuser station for fusing a multi-color image formed on a similar receiver but which is not to be subject to a clear toner overcoat.

10. The method of the claim 9 wherein the clear toner overcoat is provided in the form of a halftone.

11. The method of claim 9 wherein the belt fuser includes a pair of belts between which the receiver is passed to provide gloss enhancement of the image formed on the receiver with the fused clear toner overcoat and multi-color color image.

12. The method of claim 1 wherein the clear toner overcoat is applied in accordance with an inverse mask application having a gentle roll off in the mid-tone region of the image.

13. The method of claim 1 wherein, for a receiver of a matte paper, parameters of a fusing station used for the pre-fusing step are the same as that for the fusing of a multi-color image on a similar receiver which is not to receive a clear toner overcoat.

14. The method of claim 1 wherein the multi-color toner image is formed by a tandem electrostatographic printer where the receiver is passed through a series of color separation image forming stations and each station deposits a respective color separation image to the receiver, and an additional image forming station is provided that deposits the clear toner overcoat as an inverse mask, and further wherein the clear toner overcoat is applied in accordance with an inverse mask application having a gentle roll off in the mid-tone region of the multi-color image.

15. The method of claim 14 wherein the clear toner overcoat is adjusted in accordance with characteristics of the receiver.

16. The method of the claim 1 wherein the clear toner overcoat is deposited in accordance with an inverse mask relative to pigmented toner deposited at corresponding respective locations, and the characteristics of the inverse mask are adjusted for type of receiver.

17. The method of claim 1 wherein, in the pre-fusing step, operating parameters of a fuser station are adjusted to provide a reduced fusing condition in the pre-fusing step relative to a fusing condition employed by the fuser station for fusing a multi-color image formed on a similar receiver but which is not to be provided with a clear toner overcoat, and wherein the color gamut of the color image on the receiver is improved relative to a similar receiver having a similar color image formed thereon and covered with uniform overcoat of clear toner.

18. The method of claim 1 wherein, in the highlight areas of the color image, the clear toner overcoat provided by the inverse mask has a toner coverage of less than 100%.

19. The method of claim 18 wherein, in the highlight areas of the color image, the clear toner overcoat provided by the inverse mask has a toner coverage of from 70% to 90% inclusive.

20. The method of claim 19 wherein there is a gentle roll off of the inverse mask in the mid-tone region of the multi-color image.

21. The method of claim 1 wherein, in the highlight areas of the color image, the clear toner overcoat provided by the inverse mask has a clear toner coverage of about at least 70%, and the clear toner overcoat provided by the inverse mask increases to about 90% clear toner coverage from the highlight areas to the mid-tone area.

22. The method of claim 1 wherein the clear toner overcoat provided by the inverse mask increases in percentage clear toner coverage from the highlight areas to the mid-tone areas and then rolls off in the mid-tone to the shadow areas.

23. The method of claim 1 wherein the receiver is a rough paper and the clear toner overcoat provided by the inverse mask has a toner coverage of about 100% in the highlight areas of the color image to reduce any pinhole effect after operation by the belt fuser.

24. The method of claim 1 wherein, for the receiver, parameters of a fusing station used for the pre-fusing step are the same as that for the fusing of a multi-color image on a similar receiver which is not to receive a clear toner overcoat and not to be processed in the belt fuser.

25. The method of claim 24 wherein the receiver includes a gloss surface thereon formed prior to forming of the multi-color image upon the gloss surface.

26. The method of claim 1 wherein total toner coverage for a four-color multi-color image plus clear toner is generally less than 320%.

27. A method of forming a multi-color image on a receiver comprising:

forming a multi-color toner image, on a receiver, with toners of at least three different colors of toner pigments which form various combinations of color at different pixel locations on the receiver to form the multi-color toner image thereon;

pre-fusing the multi-color toner image to the receiver to at least tack the toners forming the multi-color toner image;

forming a clear toner overcoat upon the at least tacked multi-color toner image, the clear toner overcoat being deposited as an inverse mask; and fusing the clear toner overcoat and the multi-color toner image using a belt fuser to fix the clear toner overcoat to the receiver and provide an improved gloss to the multi-color toner image.

28. The method of claim 27 wherein, in the pre-fusing step, operating parameters of a fuser station are adjusted to provide a reduced fusing condition in the pre-fusing step relative to a fusing condition employed by the fuser station for fusing a multi-color image formed on a similar receiver but which is not to be subject to a clear toner overcoat.

29. The method of claim 28 wherein, in response to an input of receiver type and whether or not a clear toner overcoat is to be provided, signals are provided by a controller for adjustment of operating parameters of the fuser station.

30. The method of the claim 29 wherein the clear toner overcoat is provided in the form of a halftone.

31. The method of claim 29 wherein the clear toner overcoat is provided in the form of a continuous tone.

32. The method of the claim 27 wherein the clear toner overcoat is provided in the form of a halftone.

33. The method of claim 27 wherein the multi-color toner image is formed by a tandem electrostatographic printer where the receiver is passed through a series of color separation image forming stations and each station deposits a respective color separation image to the receiver.

34. The method of claim 33 wherein the clear toner is deposited onto the multi-color image by passing the receiver through a clear toner image forming station which deposits the clear toner in the form of an inverse mask.

35. The method of claim 34 wherein, in the pre-fusing step, operating parameters of a fuser station are adjusted to provide a reduced fusing condition in the pre-fusing step relative to a fusing condition employed by the fuser station for fusing a multi-color image formed on a similar receiver but which is not to be subject to a clear toner overcoat.

36. The method of the claim 34 wherein the clear toner overcoat is provided in the form of a halftone.

37. The method of claim 34 wherein the belt fuser includes a pair of belts between which the receiver is passed to provide gloss enhancement of the image formed on the receiver with the fused clear toner overcoat and multi-color color image.

38. The method of claim 27 wherein the clear toner overcoat is applied in accordance with an inverse mask application having a gentle roll off in the mid-tone region of the image.

39. The method of claim 27 wherein, for a receiver of a matte paper, parameters of a fusing station used for the pre-fusing step are the same as that for the fusing of a similar receiver which is not to receive a clear toner overcoat.

40. The method of claim 27 wherein the multi-color toner image is formed by a tandem electrostatographic printer where the receiver is passed through a series of color separation image forming stations and each station deposits a respective color separation image to the receiver, and further wherein the clear toner overcoat is applied in accordance with an inverse mask application having a gentle roll off in the mid-tone region of the multi-color image.

41. The method of claim 27 wherein the clear toner overcoat is adjusted in accordance with characteristics of the receiver.

42. The method of the claim 27 wherein the clear toner overcoat is deposited in accordance with an inverse mask relative to pigmented toner deposited at corresponding respective locations, and the characteristics of the inverse mask are adjusted for type of receiver.

43. A system for printing color images comprising:

a tandem color electrostatographic printer apparatus having three or more color printing stations for applying respective color separation toner images to a receiver member passing there through in a single pass to form a multi-color image;

a fusing station for fusing the multi-color image;

a clear toner overcoat printing station for applying a clear toner overcoat upon the multi-color toner image in the form of an inverse mask; and a belt glosser for providing enhanced gloss to the multi-color color image having the clear toner overcoat.

44. The system of claim 43 wherein a controller is programmed to control operating parameters of the fuser station to provide a reduced fusing condition relative to a fusing condition employed by the fuser station for fusing a multi-color image formed on a similar receiver but which is not to be subject to a clear toner overcoat.

45. The system of claim 44 wherein the controller is programmed, in response to an input of receiver type and whether or not a clear toner overcoat is to be provided, to provide signals for adjustment of operating parameters of the fuser station.

46. The system of claim 43 wherein the clear toner printing station is operative to provide a clear toner overcoat in the form of a halftone.

47. The system of claim 43 wherein the clear toner printing station is operative to provide a clear toner overcoat in the form of a continuous tone.

48. The system of claim 43 wherein the belt glosser includes a pair of belts between which the receiver is passed to provide gloss enhancement of the image formed on the receiver with the fused clear toner overcoat and multi-color color image.

49. The system of claim 43 wherein the clear toner printing station provides a clear toner overcoat in accordance with an inverse mask application having a gentle roll off in the mid-tone region of the image.

50. The system of claim 43 wherein a controller is programmed to control the clear toner printing station so that the clear toner overcoat is adjusted in accordance with characteristics of the receiver.

51. A system for forming a multi-color image on a receiver comprising:

means for forming a multi-color image on the receiver with materials of at least three different colors, which form various combinations of color at different pixel locations on the receiver to form the multi-color image thereon;

means for forming a clear overcoat upon the multi-color toner image, the clear overcoat being deposited as an inverse mask having a gentle roll off in the mid-tone region; and means for subjecting the multi-color toner image with the clear toner overcoat to heat and pressure in a belt glosser to provide an improved gloss to the multi-color toner image.

52. A method of forming a multi-color image on a receiver comprising:

forming a multi-color image on the receiver with materials of at least three different colors, which form various combinations of color at different pixel locations on the receiver to form the multi-color image thereon;

forming a clear overcoat upon the multi-color toner image, the clear overcoat being deposited as an inverse mask having a gentle roll off in the mid-tone region; and subjecting the multi-color toner image with the clear toner overcoat to heat and pressure in a belt glosser to provide an improved gloss to the multi-color toner image.

53. A print made in accordance with the method of claim 52.

54. The method of claim 52 wherein the multi-color toner image with the clear toner overcoat is subjected to a fusing step prior to subjecting the multi-color toner image to the belt glosser.

55. The method of claim 54 wherein the conditions for fusing of the multi-color toner image with the clear toner overcoat are the same as that for fusing of a similar multi-color toner image formed on a similar receiver that is not provided with a clear toner overcoat upon the multi-color image in the same fuser used for fusing the multi-color toner image with the clear toner overcoat.

56. The method of claim 55 wherein the receiver includes a matte or gloss finish thereon prior to depositing the multi-color image thereon.

57. A print made in accordance with the method of claim 12.

58. A method of forming a single color image on a receiver comprising:

forming a color toner image on the receiver with a toner with toner pigment in the selected color;

forming a clear toner overcoat upon the color toner image, the clear toner overcoat being deposited as an inverse mask;

pre-fusing the color toner image and clear toner overcoat to the receiver to at least tack the toner image and the clear toner overcoat; and fusing the clear toner overcoat and the color toner image using a belt fuser to fix the clear toner overcoat to the receiver and/or provide an improved gloss to the toner image.

59. A method of forming a multi-color image on a receiver comprising:

forming a multi-color image on the receiver with materials of at least three different colors, which form various combinations of colors at different pixel locations on the receiver to form the multi-color image thereon;

forming a clear overcoat upon the multi-color toner image, the clear overcoat being deposited as an inverse mask having a gentle roll off in the mid-tone region; and subjecting the multi-color toner image with the clear toner overcoat to heat and pressure to fuse the multi-color toner image with the clear toner overcoat to the receiver to form a print wherein the print that is formed exhibits lower granularity than a similar multi-color image on a similar receiver and which is not subject to an overcoat of clear toner.

60. A method of forming a print having a multi-color image supported on a receiver comprising:

forming a multi-color toner image on the receiver with toners of at least three different colors of toner pigments, which form various combinations of color at different pixel locations on the receiver to form the multi-color toner image thereon;

forming a clear toner overcoat upon the multi-color toner image, the clear toner overcoat being deposited as an inverse mask;

pre-fusing the multi-color toner image and clear toner overcoat to the receiver to at least tack the toners forming the multi-color toner image and the clear toner overcoat; and subjecting the clear toner overcoat and the multi-color toner image to heat and pressure using a belt fuser to provide an improved color gamut to the image.

* * * * *